US006872903B2

(12) United States Patent
Takenaka et al.

(10) Patent No.: US 6,872,903 B2
(45) Date of Patent: Mar. 29, 2005

(54) SURFACE JOINED MULTI-SUBSTRATE LIQUID METAL SWITCHING DEVICE

(75) Inventors: Tsutomu Takenaka, Hachioji (JP); You Kondoh, Yamato (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/738,665

(22) Filed: Dec. 16, 2003

(65) Prior Publication Data

US 2004/0245078 A1 Dec. 9, 2004

(30) Foreign Application Priority Data

Dec. 16, 2002 (JP) ..... 2002-363674

(51) Int. Cl.[7] ..... H01H 29/00
(52) U.S. Cl. ..... 200/182; 200/193
(58) Field of Search ..... 200/182–199, 200/214, 241, 220–229, 243

(56) References Cited

U.S. PATENT DOCUMENTS 6,323,447 B1 11/2001 Kondoh et al.
6,759,610 B1 * 7/2004 Dove et al. ..... 200/182
6,777,630 B1 * 8/2004 Dove et al. ..... 200/182
6,806,431 B2 * 10/2004 Kondoh et al. ..... 200/182
6,822,175 B2 * 11/2004 Kondoh et al. ..... 200/182
6,822,176 B1 * 11/2004 Fazzio ..... 200/182

FOREIGN PATENT DOCUMENTS

EP 1391903 * 2/2004
JP 08163401 6/1997

OTHER PUBLICATIONS

U.S. Appl. No. 10/627,308, filed Jul. 25, 2003, Kondoh et al.
U.S. Appl. No. 10/173,383, filed Jun. 14, 2002, Wong et al.

* cited by examiner

*Primary Examiner*—Elvin Enad
*Assistant Examiner*—Lisa Klaus

(57) ABSTRACT

A device and manufacturing method are provided comprising first and second substrates comprising a main channel provided in at least one of the substrates and a first connecting channel provided in at least one of the substrates and in fluid communication with the main channel. The main channel comprising spaced apart electrodes and filling the main channel at least partially with liquid metal. The method further comprising a first heater substrate comprising a first suspended heater element in fluid communication with the first connecting channel with the first suspended heater element operable to cause a fluid non-conductor to separate the liquid metal and selectively interconnect the electrodes and surface joining the first, second, and first heater substrates.

22 Claims, 8 Drawing Sheets

SURFACE JOINED MULTI-SUBSTRATE LIQUID METAL SWITCHING DEVICE

CROSS-REFERENCE TO RELATED APPLICATIONS

The present application contains subject matter related to a concurrently filed U.S. patent application Ser. No. 10/738,539 by You Kondoh and Tsutomu Takenaka entitled "MULTI-SUBSTRATE LIQUID METAL HIGH-FREQUENCY SWITCHING DEVICE".

BACKGROUND

1. Technical Field

The present invention relates to an electrical device, and more specifically to a liquid metal micro-relay device.

2. Background Art

There are many different types of electrical micro-relay devices, and one popular type is the reed micro-relay, which is a small, mechanical contact type of electrical micro-relay device. A reed micro-relay has two reeds made of a magnetic alloy sealed in an inert gas inside a glass vessel surrounded by an electromagnetic driver coil. When current is not flowing in the coil, the tips of the reeds are biased to break contact and the device is switched off. When current is flowing in the coil, the tips of the reeds attract each other to make contact and the device is switched on.

The reed micro-relay has problems related to large size and relatively short service life. As to the first problem, the reeds not only require a relatively large space, but also do not perform well during high-frequency switching due to their size and electromagnetic response. As to the second problem, the flexing of the reeds due to biasing and attraction causes mechanical fatigue, which can lead to breakage of the reeds after extended use.

In the past, the reeds were tipped with contacts composed of rhodium or tungsten, or were plated with rhodium or gold for conductivity and electrical arcing resistance when making and breaking contact between the reeds. However, these contacts would fail over time. This problem with the contacts has been improved with one type of reed micro-relay called a "wet" relay. In a wet relay, a liquid metal, such as mercury, is used to make the contact. This solved the problem of contact failure, but the problem of mechanical fatigue of the reeds remained unsolved.

In an effort to solve these problems, electrical micro-relay devices have been proposed that make use of the liquid metal in a channel between two micro-relay electrodes without the use of reeds. In the liquid metal devices, the liquid metal acts as the contact connecting the two micro-relay electrodes when the device is switched ON. The liquid metal is separated between the two micro-relay electrodes by a fluid non-conductor when the device is switched OFF. The fluid non-conductor is generally high-purity nitrogen or some other such inert gas.

With regard to the size problem, the liquid metal devices afford a reduction in the size of an electrical micro-relay device since reeds are not required. Also, the use of the liquid metal affords longer service life and higher reliability.

The liquid metal devices are generally manufactured by joining together two substrates with a heater in between to heat the gas. The gas expands to separate the liquid metal to open and close a circuit. Previously, the heaters were inline resistors patterned on one of the substrates between the two substrates. The substrates were of materials such as glass, quartz, and gallium arsenide upon which the heater material was deposited and etched. Since only isotropic etching could be used, the heater element would consist of surface wiring. The major drawback of surface wiring is that such wiring has poor high-frequency characteristics, high-connection resistance, and poor thermal transfer to the gas.

More recently, suspended heaters have been developed. A suspended heater refers to a configuration in which the heating elements are positioned so that they can be completely surrounded by the gas.

Problems still exist with these liquid metal devices, which include difficulties with hermetically sealing the heaters.

The problems further include minimizing resistance throughout the liquid metal devices.

The problems still further include poor the high-frequency characteristics of the electrical path through the liquid metal devices.

The problems still further include problems related to poor impedance matching for high-frequency signals.

Solutions to these problems have been long sought, but prior developments have not taught or suggested any solutions and, thus, solutions to these problems have long eluded those skilled in the art.

DISCLOSURE OF THE INVENTION

The present invention provides a device and manufacturing method comprising first and second substrates comprising a main channel provided in at least one of the substrates and a first connecting channel provided in at least one of the substrates and in fluid communication with the main channel. The main channel comprising spaced apart electrodes and filling the main channel at least partially with liquid metal. The method further comprising a first heater substrate comprising a first suspended heater element in fluid communication with the first connecting channel with the suspended heater element operable to cause a fluid non-conductor to separate the liquid metal and selectively interconnect the electrodes and surface joining the first, second, and first heater substrates.

The present invention provides simplified hermetic sealing of the heaters.

The present invention provides minimized resistance throughout the liquid metal devices.

The present invention provides excellent high-frequency characteristics of the electrical path through the liquid metal devices.

The present invention provides excellent impedance matching for high-frequency signals.

Certain embodiments of the invention have other advantages in addition to or in place of those mentioned above. The advantages will become apparent to those skilled in the art from a reading of the following detailed description when taken with reference to the accompanying drawings.

DETAILED DESCRIPTION OF THE INVENTION

Figure 1:
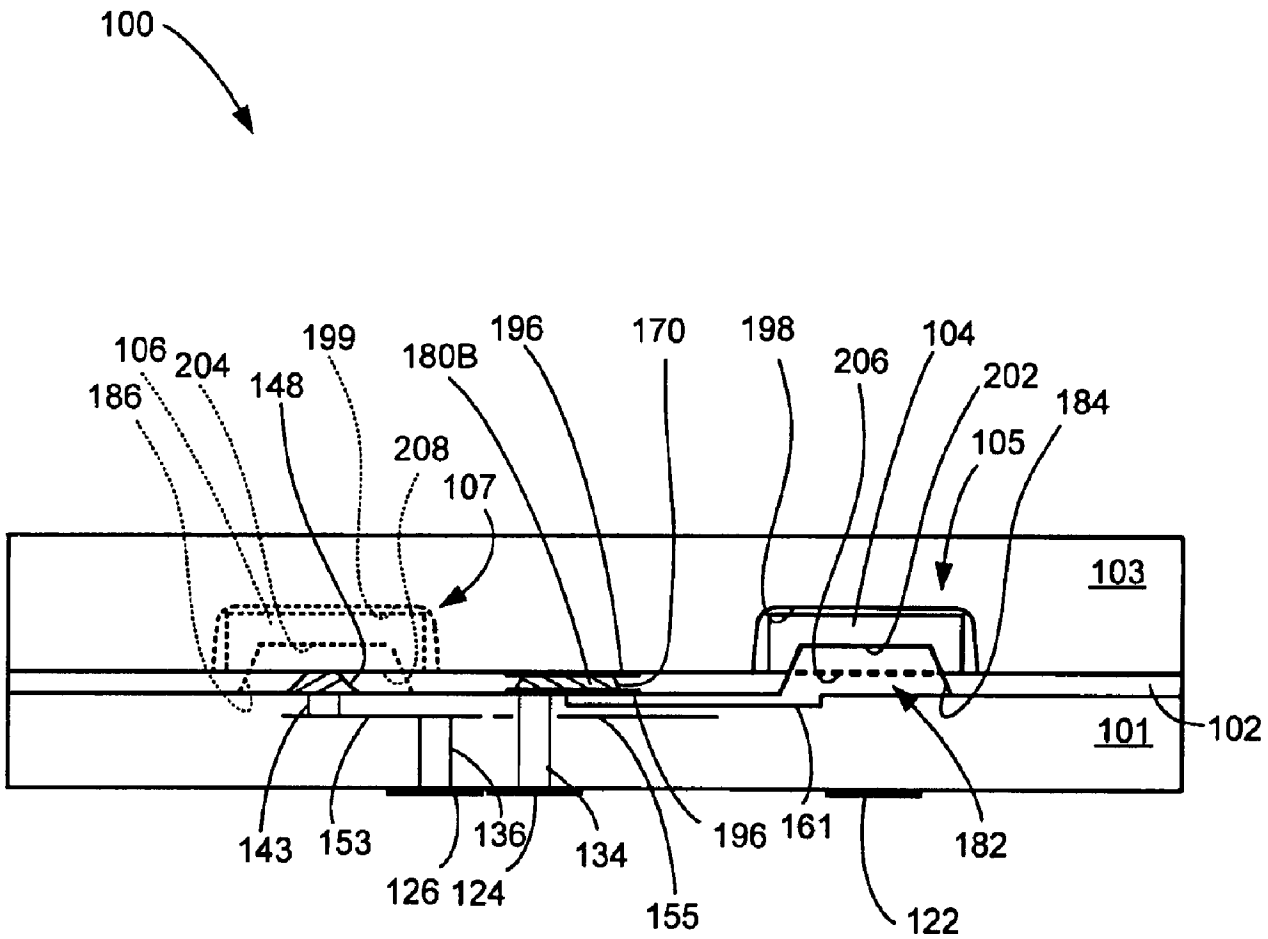
FIG. 1 is a cross-sectional view of the structure of FIG. 2 taken along line 1—1 of a liquid metal micro-relay in accordance with an embodiment of the present invention.

The term "horizontal" as used in herein is defined as a plane parallel to the major surface of a substrate, regardless of its orientation. Terms, such as "top", "bottom", "above", "below", "over", and "under" are defined with respect to the horizontal plane.

In the following description, numerous specific details are given to provide a thorough understanding of the invention. However, it will be apparent that the invention may be practiced without these specific details. In order to avoid obscuring the present invention, some well-known configurations and process steps are not disclosed in detail. In addition, the drawings showing embodiments of the apparatus are semi-diagrammatic and not to scale and, particularly, some of the dimensions are for the clarity of presentation and may be exaggerated in the drawing FIGs. The same numbers will be used in all the drawing FIGs. to relate to the same elements.

Figure 2:
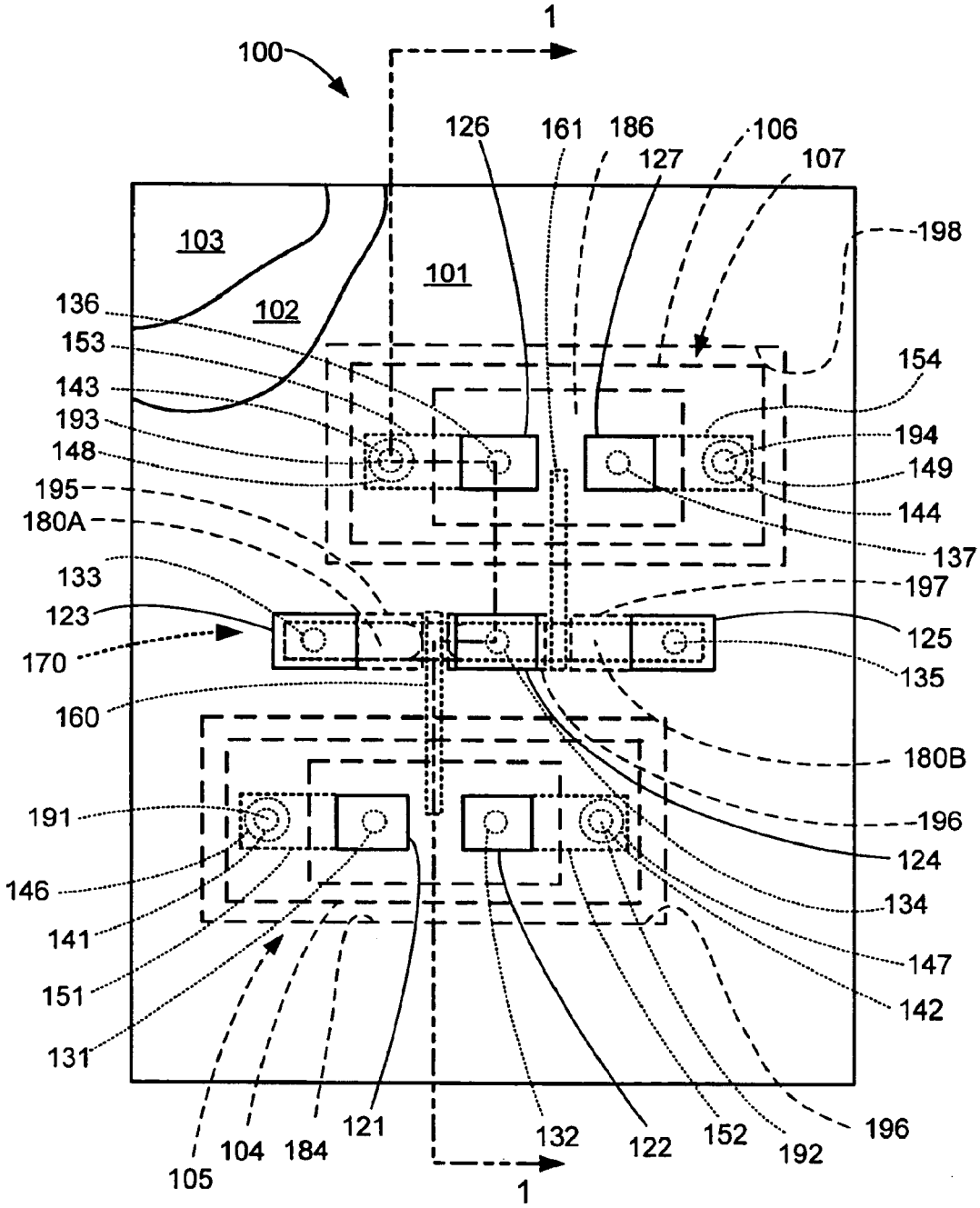
FIG. 2 is a bottom view of the structure of FIG. 1.

Referring now to FIGS. 1 and 2, therein are shown a cross-sectional view of a liquid metal micro-relay 100 taken along line 1—1 of FIG. 2 and a bottom view of the liquid metal micro-relay 100, both in accordance with an embodiment of the present invention.

The liquid metal micro-relay 100 comprises first, second, and third substrates 101, 102, and 103, which are surface joined together. The second substrate 102 has first and second heater substrates 104 and 106 of respective first and second heaters 105 and 107 surface joined to its top surface.

The term "surface joined" as used herein is defined as two substrates being joined by a joining technique where their entire flat surface areas which are capable of being in contact with each other, are bonded by a thin film of material that is planar on both sides. This simultaneously bonds and seals the two substrates. The term "surface joining" refers to a technique for joining which results in substrates being surface joined. Due to the thinness of the film and the expanse of surface area bonded, the surface joining eliminates the need for special sealing resins to form hermetic bonds or seals in various locations around the surface joined areas. Consequently, the manufacturing process can be simplified, and the cavity volumes of the heaters can be designed more accurately.

The thin film of material is generally an adhesive, such as a resin or an epoxy. Further, due to the thinness of the film between the surface joined substrates, an extremely strong bond is formed. The bond is stronger than that provided by the thicker films used in the past.

As shown in FIGS. 1 and 2, the first substrate 101 has a number of bonding pads 121 through 127 on its bottom horizontal surface for connection of electrical wires to the outside world. The bonding pads 121 through 127 are electrically conductive and connected to via conductors 131 through 137 in, and extending at least partially through, the first substrate 101. The via conductors 133, 134, and 135 may be of any cross section including square, rectangular, or round to form the contact electrodes for the liquid metals 180A and 180B.

The first substrate 101 further has via conductors 141 through 144, which also extend at least partially through the first substrate 101. The via conductors 131 through 137 and 141 through 144 can be of standard conductor materials such as copper (Cu) or aluminum (Al), and of semiconductor device type vias of tungsten (W), tantalum (Ta), or titanium (Ti).

The via conductors 141–144 may also be of a liquid metal since they are totally enclosed. However, it has been discovered that better contact connections may be made with other materials such as flexible or anisotropic conductive materials. Examples of flexible conductive materials include combinations of flexible materials such as silicone rubber or fluorosilicone rubber and the like containing conductive flakes of conductive metals, such as copper, gold, aluminum, nickel and the like. Examples of anisotropic conductive materials include carrier materials, such as polyester resin, polyamide resin, polycarbodiimide resin, phenoxy resin, epoxy resin, acrylic resin, saturated polyester resin and the like containing particles of conductive metals, such as copper, gold, aluminum, nickel and the like.

The term "electrical path" is used to include the peripheral structural bodies that have an electrical effect on the basic electrical path (i.e., elements that determine the circuit impedance of the basic electrical path). In cases where a dielectric is disposed in the vicinity of the basic electrical path, this dielectric commonly forms a portion of the electrical path. Furthermore, in cases where conductors or ground surfaces are disposed in the vicinity of the basic electrical path, these conductors and ground surfaces commonly form a portion of the electrical path.

Embedded in the first substrate 101 are conductors 151 through 154. The conductor 151 connects the via conductors 131 and 141, the conductor 152 connects the via conductors 132 and 142, the conductor 153 connects the via conductors 136 and 143, and the conductor 154 connects the via conductors 137 and 144.

A ground plane 155, which is optional, may be in any position that permits impedance matching for high-frequency signal transmission through the liquid metal micro-relay 100. The ground plane 155, for purposes of illustration only, is shown positioned in the first substrate 101.

Formed in the top of the first substrate 101 are grooves defining first and second connecting channels 160 and 161.

In the present invention, the different substrates may be manufactured out of different materials such as silicon (Si), glass, ceramic, or combinations thereof, which the liquid metals will not wet. The first substrate 101 in one embodiment is a finished multilayer structure of ceramic, the second substrate 102 is glass, and the third substrate 103 is of glass. The first and second heater substrates 104 and 106 are of silicon.

In manufacturing substrates out of ceramic and glass, unfired materials, i.e., "green" or "raw" ceramics and glasses, are processed to make multilayer structures, which are machined and then fired. These materials have been used because of their mechanical integrity and ability to be incorporated with electrical circuitry. In some cases, they were used because of high-temperature resistance, good high-frequency signal characteristics, or good thermal coefficient properties.

The multilayer ceramic manufacturing process consists of forming a slurry of ceramic and glass powders combined with thermoplastic organic binders and high vapor pressure solvents. The slurry is doctor-bladed onto a carrier. After volatilization of the high vapor pressure solvents and removal from the carrier, a green ceramic tape is formed. The green ceramic tape generally has sufficient rigidity so that it is self-supporting.

A mechanical or laser operation may be used to form via holes, channels, recesses, or other structures in the green ceramic tape. Green ceramic tape is used at this point because it is softer than fired ceramic and thus easier to process by normal manufacturing tools for high-volume manufacturing. For example, vias can easily be drilled, punched, or otherwise formed in the green ceramic tape. Similarly, other processes such as grinding and laser ablation are easily performed on the green ceramic tape to form channels or ducts.

In one embodiment, the first and second connecting channels 160 and 161 are formed by means of an excimer laser. A green sheet with a ceramic multilayer substrate is used and is advantageous for manufacturing large quantities at one time. While using a laser results in an increase in the number of processes required, it is advantageous from the standpoint of producing a fine pattern. Direct beam drawing can be performed by means of a yttrium aluminum garnet (YAG) laser, and a pattern can be burned by means of an excimer laser using a mask. A YAG laser does not require a mask; however, control of the depth is difficult, and is disadvantageous in some respects for mass production. In the case of an excimer laser, control of the depth is easy in comparison, and mass production is possible if a mask is used. The most appropriate of these methods can be selected and used according to the production quantity and pattern involved.

Thick-film printing techniques can be used to lay down conductor material on the green ceramic tape in the form of a fusible metal paste. The fusible metal paste can also fill the vias and channels or ducts to form conductor structures. These conductor structures allow the connection resistance to be low and permit impedance matching for high-frequency signal transmission.

A number of green ceramic tapes are placed on top of each other and aligned in multiple layers. Open vias extending through one or more of the green layers can be provided with inserts to transmit the lamination force through unsupported regions from the top tape to the bottom tape. The green ceramic tapes are then compressed and fired.

During the compression, the thermoplastic component (e.g., polyvinyl butyral) within the green layers flows and results in mutual adhesion of the green layers and conformation of the green layers around the pattern of metal paste. In addition to binding the individual green layers into a coherent green laminate structure, the lamination operation determines the density of the green laminate structure and thus the shrinkage during firing and the dimensional accuracy of the fired laminate structure. The green laminate structure should have a uniform density to prevent differential shrinkage during firing.

A high-temperature firing of the green laminate structure results in a volatilization of the organic components and sintering of the coherent green laminate structure into a monolithic ceramic. At the same time, the fusible metal paste fuses into electrically and mechanically connected conductors, electrodes, and pads.

By way of example, the lamination operation can impose a compressive stress on the order of 3.4e6 Pa (500 psi) to 1.4e7 Pa (2,000 psi) on the green laminate structure, and the firing can be performed at an elevated temperature of approximately 75° C.

The second substrate 102 contains at least one main channel 170, which is open to first ends of the first and second connecting channels 160 and 161 in the first substrate 101. The main channel 170 at least partially contains a liquid metal, such as mercury (Hg) or gallium (Ga), or gallium-indium (Gain) alloys. The main channel 170 can be filled with liquid metal by a number of different methods including placing the liquid metal in the main channel 170 or relying on the high surface tension of the liquid metal to hold it to a shape on a lower substrate so that the main channel 170 in an upper substrate can be filled by lowering the upper substrate over the liquid metal on the lower substrate.

The liquid metal is separated into two parts, liquid metal 180A and liquid metal 180B, by a fluid non-conductor 182, such as high-purity nitrogen or some other such inert gas. The first and second connecting channels 160 and 161 are formed to be smaller than the main channel 170. This prevents the liquid metals 180A and 180B from entering the first and second connecting channels 160 and 161, but allows the fluid non-conductor 182 to do so.

The main channel 170 may be sandblasted or etched in the second substrate 102 to have a substantially trapezoidal or rectangular cross section with minimal wettability, so that the expansive force of the fluid non-conductor 182 is efficiently transmitted to the liquid metal 180A or 180B to increase the reliability of switching.

The second substrate 102 also contains openings or first and second heater chambers 184 and 186 under the first and second heater substrates 104 and 106. The second ends of the first and second connecting channels 160 and 161 in the first substrate 101 are positioned to connect the main channel 170 and the first and second heater chambers 184 and 186, respectively.

Liquid metals 191 through 194 may be provided in conductor vias 141 through 144, and 146 through 149 to provide flexible and conforming electrical contacts to first and second suspended heater elements 206 and 208 on the first and second heater substrates 104 and 106. The conductor vias 146 through 149 may also be filled with other materials such as flexible or anisotropic materials to obtain the same effect.

The second substrate 102 is also provided with electrodes represented by electrodes 195 through 197 for providing electrical connection to the conductor vias 133 through 135, respectively, which are generally metal filled conductor vias to provide better sealing of the main channel 170. The electrodes 195 through 197 also provide reduced friction and reduced resistance surfaces for the liquid metals 180A and 180B. Similar electrodes (similarly numbered) can be placed on the second substrate 102 above the main channel 170 to provide further reduced friction and reduced resistance surfaces.

The third substrate 103 is provided with first and second clearance chambers 196 and 198, which are large enough to contain the first and second heater substrates 104 and 106, respectively. The first and second heater substrates 104 and 106 are also surface joined to the second substrate 102. The first and second heater substrates 104 and 106 are formed with first and second heater openings 202 and 204, respectively, having the first and second suspended heater elements 206 and 208, respectively. It will be understood that the substrates may be surface joined at different times and in different sequences.

Figure 3A:
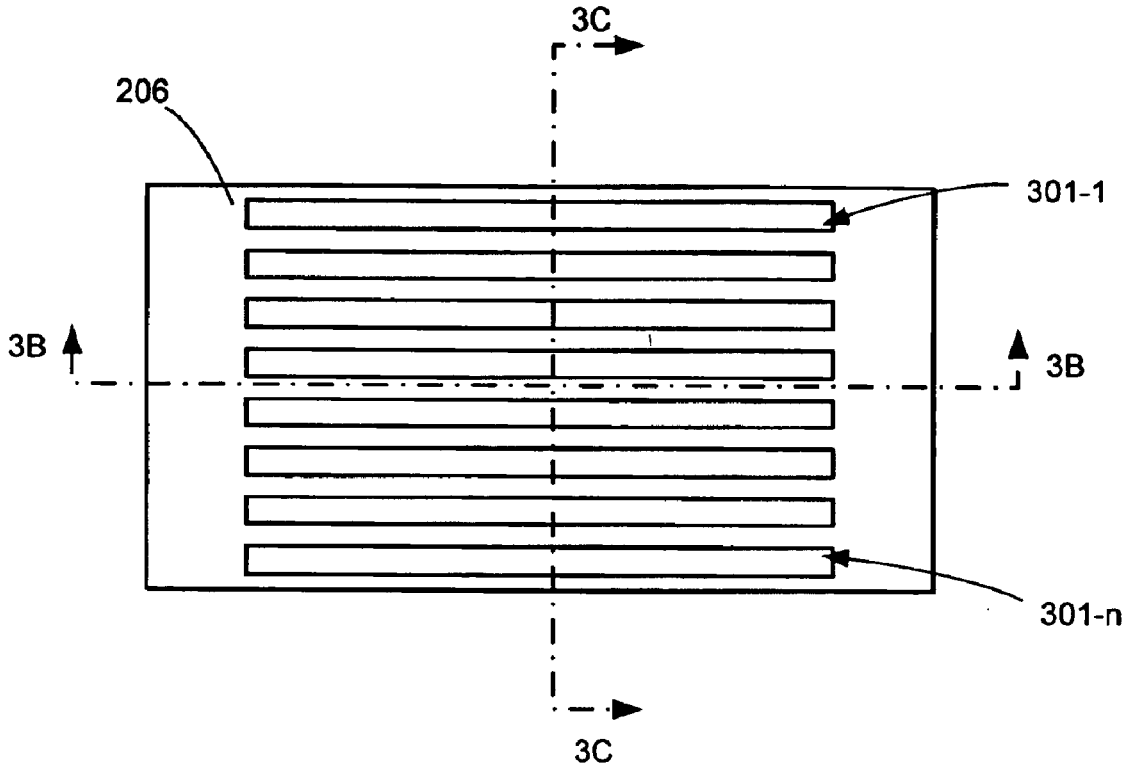
FIG. 3A is a plan view of a heater used in the present invention.
Figure 3B:
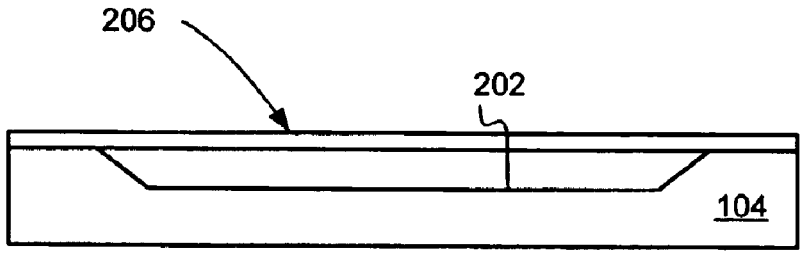
FIG. 3B is a cross-sectional view of the structure of FIG. 3A taken along line 3B—3B.
Figure 3C:
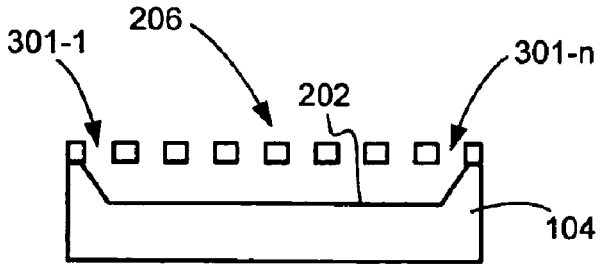
FIG. 3C is a cross-sectional view of the structure of FIG. 3A taken along line 3C—3C.

Referring now to FIGS. 3A–C, therein is shown the first heater 105, which is the same configuration as the second heater 107. The second heater 107 and related channels are optional in the present invention.

In FIG. 3A is shown a plan view of the heater 105 with the first suspended heater element 206 having openings 301-1 through **301-*n*. In one embodiment, a polysilicon film with a thickness of 100 nm can be used as a suspended heater element; however, it is also possible to use a metal layer or a material such as platinum (Pt), nickel (Ni), or chrome (Cr) as the heating element. In this latter case, it is necessary to coat the metal layer with a material, e.g., silicon oxide ($SiO_2$) or silicon nitride (SiN), that does not react with the vapor of the liquid metal used in the liquid metal micro-relay 100**.

In FIG. 3B is shown a cross-section of the structure of FIG. 3A taken along line 3B—3B. The first heater substrate 104 has the first suspended heater element 206 suspended over the first heater opening 202. In FIG. 3C, taken along the line 3C—3C of FIG. 3A, therein is shown the first suspended heater element 206 and the openings 301-1 through **301-*n* over the first heater opening 202. The first suspended heater element 206** is shown as a ladder shape, but it may be a mesh shape, a honeycomb shape, a membrane shape that has no pattern or any other shape that will allow the passage of the fluid non-conductor through it. The advantage of such a suspended heater element is that the efficiency with which the gas is heated is high, so almost all the heat generated by the suspended heater element heats the fluid non-conductor.

The first heater opening 202 can be manufactured and accurately controlled by anisotropic etching, which allows for accurate regulation of the volume of fluid non-conductor surrounding the first suspended heater element 206. As shown in FIG. 1, the first and second suspended heater elements 206 and 208 are also suspended over the first and second heater chambers 184 and 186, respectively.

The first suspended heater element 206 is in electrical contact with the liquid metals 191 and 192 and the second suspended heater element 208 is in electrical contact with the liquid metals 193 and 194. Each via is filled with liquid metal such that the meniscus of the liquid metal in the vias conforms to the suspended heater element when the suspended heater element abuts the second substrate 102 to provide a minimum resistance contact. The liquid metal can be different in the via conductors and the main channel, but minimum resistance throughout may be obtained by having the same liquid metal in all the via conductors and the main channel.

In operation, by reference to FIGS. 1, 2, and 3A–C, by passing a current between the bonding pads 121 and 122, the first suspended heater element 206 of FIG. 2 is heated causing the gas around the first suspended heater element 206 to expand and move through the first heater chamber 184 and the second connecting channel 161 to cause the liquid metal 180A to separate with a center portion joining with the liquid metal 180B. This opens the conductive connection between the bonding pads 123 and 124, and closes the conductive connection between the bonding pads 124 and 125.

Conversely, passing a current between the bonding pads 126 and 127 heats the second suspended heater element 208 of FIG. 2 and causes the liquid metal 180B to be separated to return the liquid metal micro-relay 100 to the position shown in FIG. 1. The surface joining of the first and third substrates 101 and 103 to the second substrate 102 prevents any leakage of the fluid non-conductor 182 out of the liquid metal micro-relay 100 even when heated, and also prevents leakage of atmosphere into the liquid metal micro-relay 100.

Figure 4:
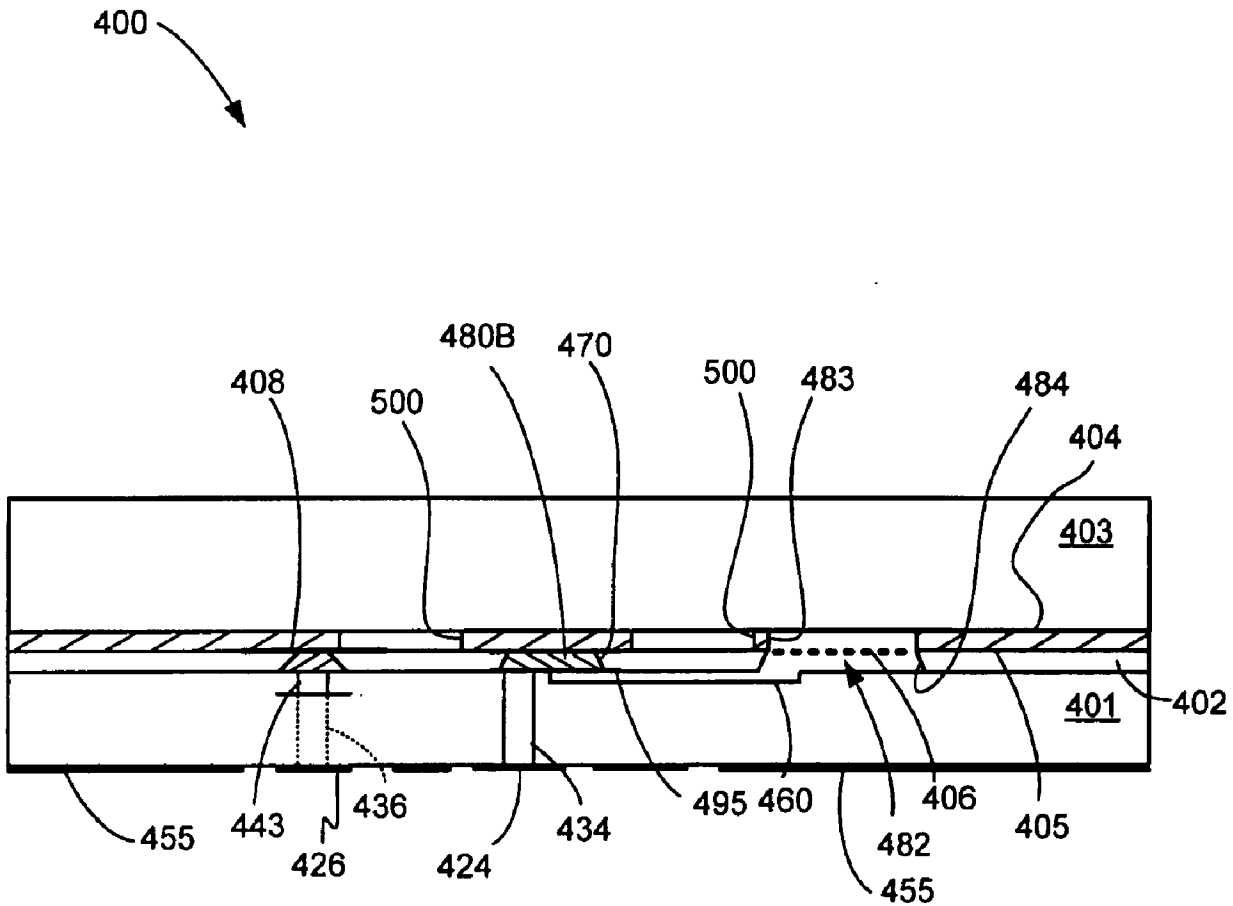
FIG. 4 is a cross-sectional view of the structure of FIG. 5 taken along line 4—4 of a liquid metal micro-relay in accordance with a further embodiment of the present invention.
Figure 5:
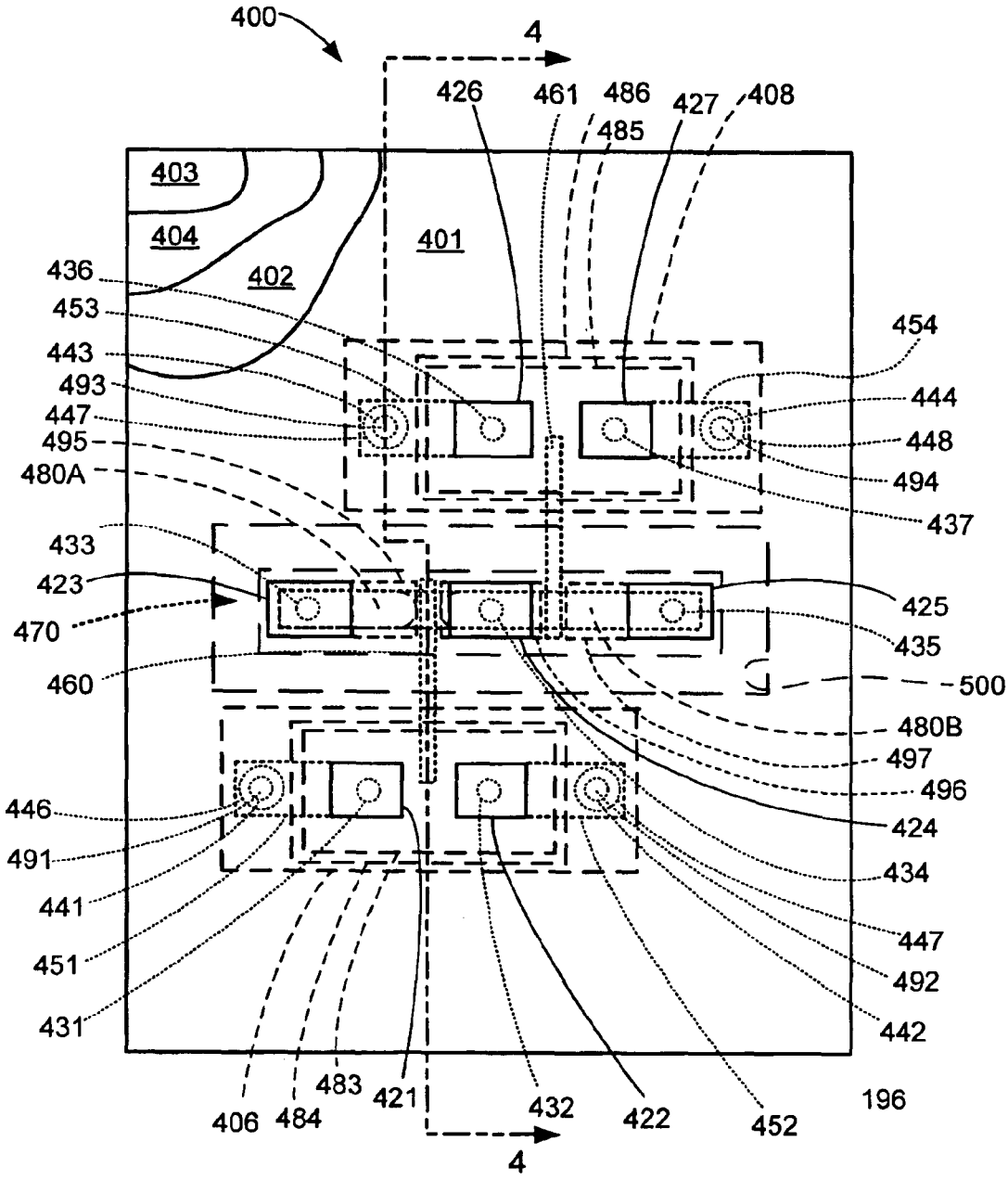
FIG. 5 is a bottom view of the structure of FIG. 4.

Referring now to FIGS. 4 and 5, therein are shown a cross-section of a liquid metal micro-relay 400 taken along line 4—4 of FIG. 5 and a bottom view of the liquid metal micro-relay 400, both in accordance with a further embodiment of the present invention.

The liquid metal micro-relay 400 comprises first, second, and third substrates 401, 402, and 403, respectively. Positioned between the second and third substrates 402 and 403 is a heater substrate 404. The first and second substrates 401 and 402 are surface joined together; the second substrate 402 and the heater substrate 404 are surface joined; and the heater substrate 404 and the third substrate 403 are surface joined.

As shown in FIGS. 4 and 5, the first substrate 401 has a number of bonding pads 421 through 427 on its bottom horizontal surface for connection of electrical wires to the outside world. The bonding pads 421 through 427 are electrically conductive and connected to via conductors 431 through 437 in, and extending at least partially through, the first substrate 401.

The first substrate 401 further has via conductors 441 through 444, which also extend partially through the first substrate 401. The via conductors 431 through 437 and the via conductors 441 through 444 can be of standard conductor materials such as copper or aluminum, and semiconductor device type vias of tungsten, tantalum, or titanium. The via conductors 431, 432, 436, and 437 may also be of a liquid metal since they are totally enclosed.

Embedded in the first substrate 401 are conductors 451 through 454. The conductor 451 connects the via conductors 431 and 441, the conductor 452 connects the via conductors 432 and 442, the conductor 453 connects the via conductors 436 and 443 and the conductor 454 connects the via conductors 437 and 444.

A ground plane 455, which is optional, may be in any position that permits impedance matching for high-frequency signal transmission through the liquid metal micro-relay 400. The ground plane 455 in FIG. 4 is formed on the bottom of the first substrate 401.

Formed in the top of the first substrate 401 are first and second connecting channels 460 and 461.

As previously explained, different substrates may be manufactured out of different materials which are not wet by liquid metals. In one embodiment, the first substrate 401 in one embodiment is a finished multilayer structure of ceramic, the second substrate 402 is glass, and the third substrate 403 is also glass. The heater substrate 404 is of single-crystal silicon. In addition, a insulator layer 405 is formed on the surface of the heater substrate 404 surface joined to the second heater substrate 402 in order to insulate the single-crystal silicon from direct currents in the liquid metal micro-relay 400 and to seal a main channel 470. The insulator layer 405 is formed by thermal oxidation of the silicon.

The second substrate 402 contains the main channel 470, which is open to first ends of the first and second connecting channels 460 and 461 in the first substrate 401. The main channel 470 contains a liquid metal, such as mercury or gallium, or gallium-indium alloys, separated into two parts, liquid metal 480A and liquid metal 480B, by a fluid non-conductor 482, such as high-purity nitrogen or some other such inert gas. The first and second connecting channels 460 and 461 are formed to be smaller than the main channel 470. This prevents the liquid metals 480A and 480B from entering the first and second connecting channels 460 and 461, but allows the fluid non-conductor 482 to do so.

The second substrate 402 also contains first and second heater chambers 484 and 486 under the heater substrate 404. The second ends of the first and second connecting channels 460 and 461 in the first substrate 401 are positioned to connect the main channel 470 and the first and second heater chambers 484 and 486, respectively.

Liquid metals 491 through 494 are provided in the conductor vias 441, 442, and 446 through 449 to provide flexible and conforming electrical contacts to first and second suspended heater elements 406 and 408 on the heater substrate 404.

The second substrate 402 is also provided with electrodes represented by electrodes 495 and 497 for providing electrical connection to the conductor vias 433, 434, and 435, respectively. The electrodes 495 through 497 also provide reduced friction and reduced resistance surfaces for the liquid metals 480A and 480B. Similar electrodes (similarly numbered) can be placed on the second substrate 402 above the main channel 470 to provide further reduced friction and reduced resistance surfaces.

The third substrate 403 may be a glass flat having a planar surface, which is surface joined to the heater substrate 404. The heater substrate 404 is a single-crystal silicon layer, which allows for the easy formation of suspended heaters. The heater substrate 404 is formed with openings that define first and second heater openings 483 and 485 respectively over the first and second heater chambers 484 and 486 in the second substrate 402. The third substrate 403 closes off the tops of the first and second heater openings 483 and 485.

While the single-crystal silicon layer of the heater substrate 404 is easily manufactured, it has a relatively large dielectric loss. When the liquid metal micro-relay 400 is closed and conducting power, the high-frequency characteristics of the electrical path have been found to deteriorate.

More specifically, the high-frequency characteristics of the electrical path deteriorate where the heater substrate 404 is of single-crystal silicon and the ground plane 455 has a width that is greater than the width of the electrical path formed by the electrodes 423, 424, and 425, and liquid metals 480A and 480B in the main channel 470.

It has been discovered that the deterioration of the high-frequency characteristics can be prevented by surface joining the heater substrate 404 to the third substrate 403 when the third substrate 403 has low dielectric loss in comparison to the single-crystal silicon. Both ceramic and glass provide a low dielectric loss compared to silicon. Since the third substrate 403 is a flat structure, glass is used.

Further, it has been discovered that a gap 500 in the heater substrate 404 around the position of the main channel 470 and of the electrodes 423, 424, and 425, and liquid metals 480A and 480B in the main channel 470 further improves impedance matching for high-frequency signals. The width of the gap 500 can be about equal to the thickness of the first substrate 401.

For example, the width of the gap 500 around the main channel 470 is about 100 $\mu$m where the thickness of the first substrate 401 is 100 $\mu$m and the heater substrate 404 is 50 $\mu$m thick and its resistivity is 1000 ohm-centimeters. It will be understood that a thickness of approximately 100–400 $\mu$m is desirable from the standpoint of maintaining sufficient structural strength while achieving compact size of the liquid metal micro-relay 400.

Since flat, easily formed substrates are used in the above embodiment, the liquid metal micro-relay 400 is especially adapted for mass production.

Figure 6:
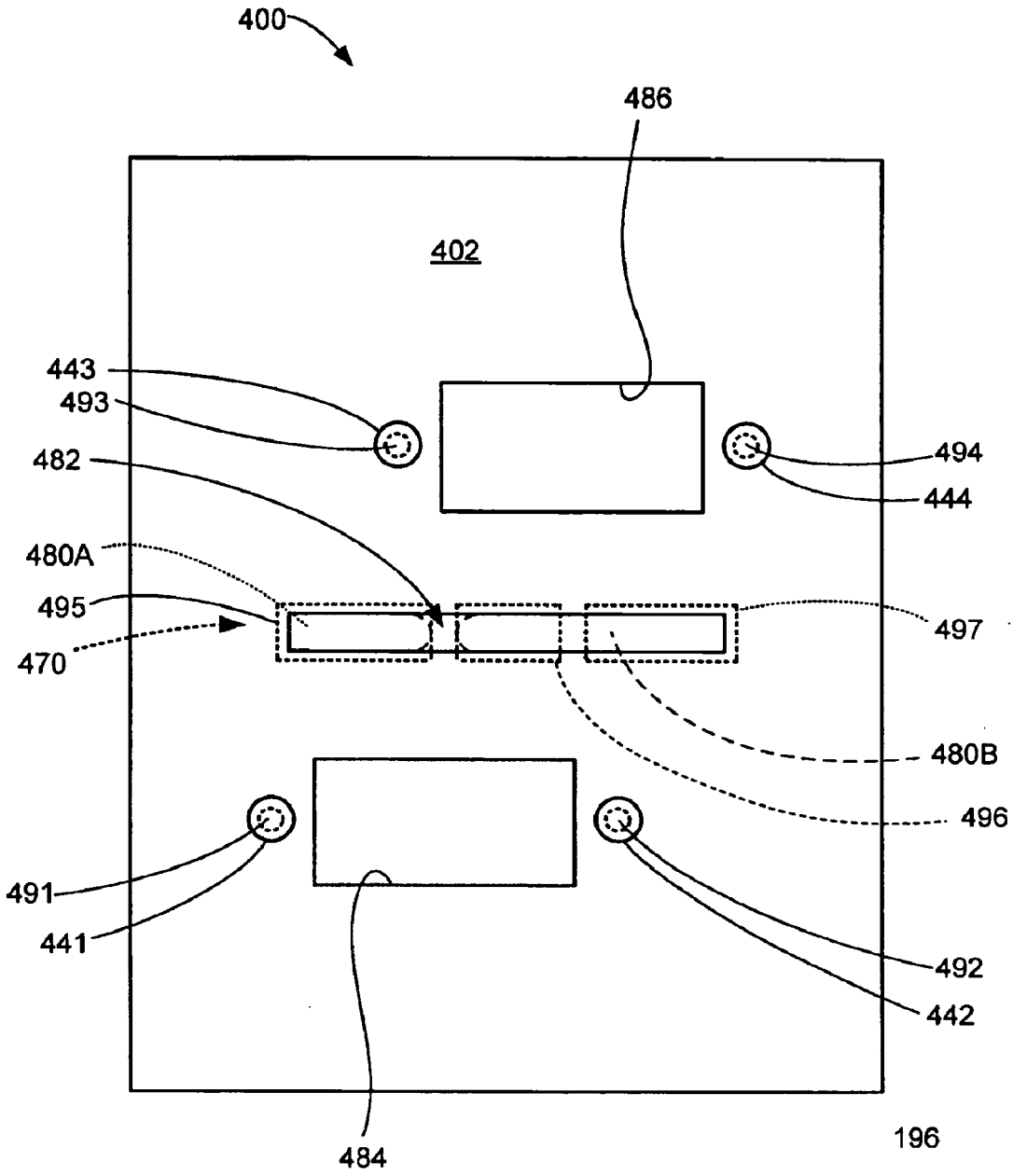
FIG. 6 is a bottom view of the second substrate of FIG. 4.

Referring now to FIG. 6, therein is shown a bottom view of the second substrate 402 of FIG. 4. Also shown are the first and second heater chambers 484 and 486, the main channel 470, and the liquid metal 491 through 494. On top of the second substrate 402 are the electrodes 423, 424, and 425.

Figure 7:
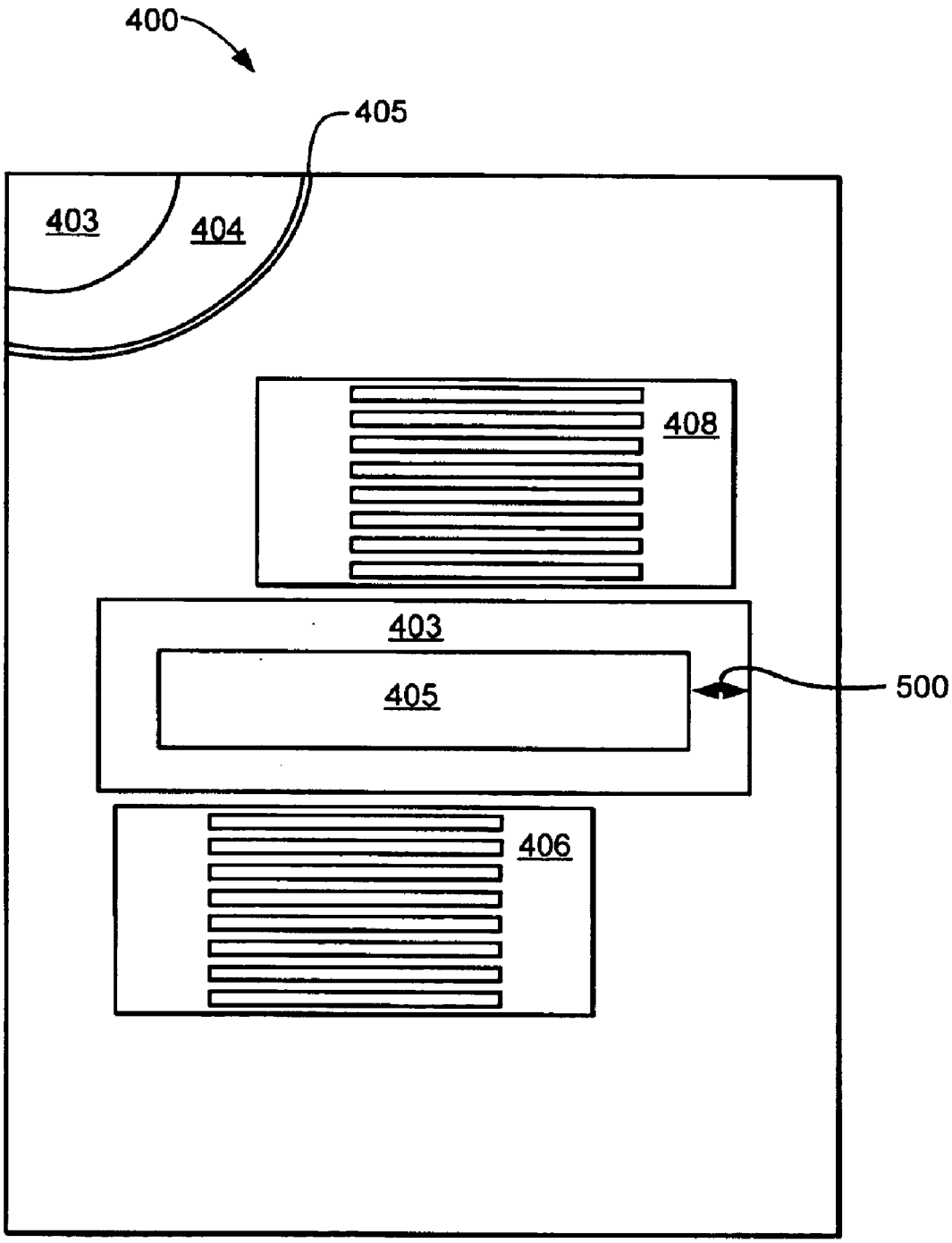
FIG. 7 is a bottom view of the heater substrate of FIG. 4.

Referring now to FIG. 7, therein is shown a bottom view of the heater substrate 404 of FIG. 4. The heater substrate 404 has the first and second suspended heater elements 406 and 408 and the gap 500. FIG. 7 shows the width of the gap 500 as extending parallel to the plane of the heater substrate 404.

The operation of the liquid metal micro-relays 100 and 400 is the same.

The manufacturing of the liquid metal micro-relays 100 and 400 is almost the same except as noted below.

Figure 8:
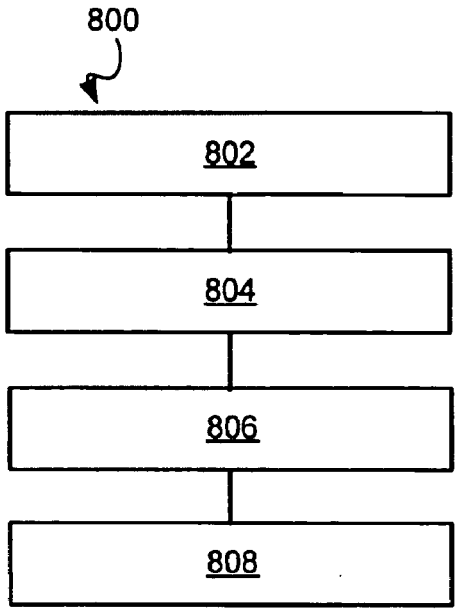
FIG. 8 is a flow chart for a method of manufacturing the present invention.

Referring now to FIG. 8, therein is shown a flow chart for a method 800 of manufacturing the present invention that comprises: a block 802 of forming first and second substrates comprising a main channel provided in at least one of the substrates and a first connecting channel provided in at least one of the substrates, the first connecting channel in fluid communication with the main channel, the main channel having spaced apart electrodes; a block 804 of filling the main channel at least partially with a liquid metal; a block 806 of forming a first heater substrate comprising a first suspended heater element in fluid communication with the first connecting channel, the suspended heater element operable to cause a fluid non-conductor to separate the liquid metal and selectively interconnect the electrodes; and a block 808 of surface joining the first, second, and first heater substrates.

Figure 9:
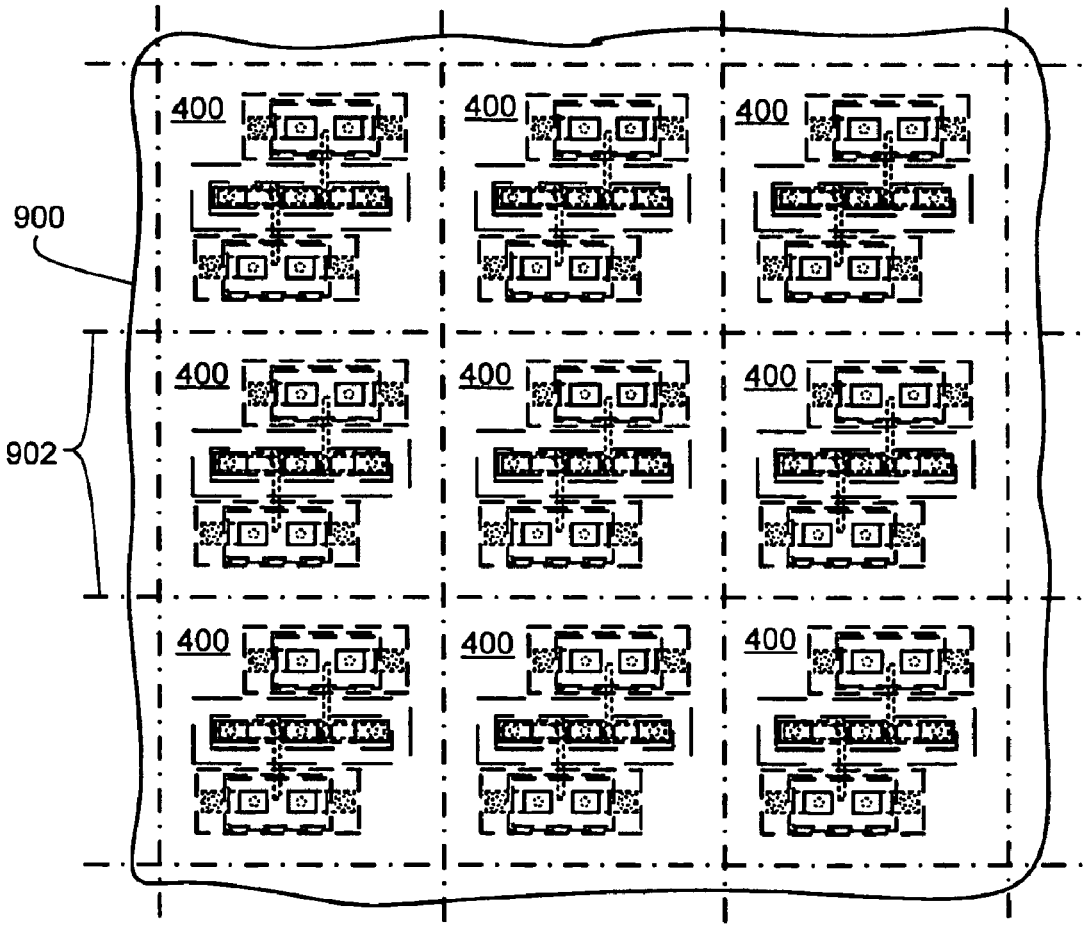
FIG. 9 is a structure of stacked substrates.

Referring now to FIG. 9, therein is shown a structure of stacked substrates 900, which contains a large number of liquid metal micro-relays 400, which are formed prior to singulation. The liquid metal micro-relays 400 are completed by a process such as sawing along singulation lines 902, which forms the individual liquid metal micro-relays 400. Thus, the liquid metal micro-relays 400 are suitable for mass production since minimal alignment of the various substrates is required.

While the invention has been described in conjunction with specific embodiments, it is to be understood that many alternatives, modifications, and variations will be apparent to those skilled in the art in light of the foregoing description. Accordingly, it is intended to embrace all such alternatives, modifications, and variations that fall within the scope of the included claims. All matters hithertofore set forth or shown in the accompanying drawings are to be interpreted in an illustrative and non-limiting sense.

The invention claimed is:

1. A method comprising:

forming first and second substrates comprising a main channel provided in at least one of the substrates and a first connecting channel provided in at least one of the substrates, the first connecting channel in fluid communication with the main channel, the main channel having spaced apart electrodes;

filling the main channel at least partially with a liquid metal;

forming a first heater substrate comprising a first suspended heater element in fluid communication with the first connecting channel, the first suspended heater element operable to cause a fluid non-conductor to separate the liquid metal and selectively interconnect the electrodes; and surface joining the first, second, and first heater substrates.

2. The method of claim 1 wherein:

forming the first and second substrates forms the first and second substrates additionally comprising conductor vias provided in at least one of the substrates;

and further comprising:

filling the conductor vias with at least one of liquid metal, flexible conductive material, anisotropic conductive material, and a combination thereof.

3. The method of claim 1 wherein:

forming the first and second substrates forms a second connecting channel provided in at least one of the substrates, the second connecting channel in fluid communication with the main channel;

and further comprising:

forming a third substrate comprising first and second clearance chambers provided therein;

forming a second heater substrate comprising a second suspended heater element in fluid communication with the second connecting channel;

surface joining the second heater substrate to the second substrate; and surface joining the third substrate to the second substrate with the first and second heater substrates respectively in the first and second clearance chambers.

4. The method of claim 1 wherein:

forming the first substrate comprising a ground plane on the bottom thereof; and forming the first heater substrate comprising a gap around the position of the main channel in the second substrate.

5. The method of claim 1 wherein:

forming the first heater substrate comprising an insulator layer under the first suspended heater element.

6. The method of claim 1 additionally comprising:

singulating the first, second, third, and first heater substrates after surface joining.

7. A method comprising:

forming first and second substrates comprising a main channel provided in at least one of the substrates, a first heater chamber in at least one of the substrates, and a first connecting channel provided in at least one of the substrates and extending between the first heater chamber and the main channel, the main channel having spaced apart electrodes;

filling the main channel at least partially with a liquid metal by placing the liquid metal in the main channel or by placing the main channel over the liquid metal;

forming a first heater substrate comprising a first suspended heater element in fluid communication with the first connecting channel, the first suspended heater element operable to cause a fluid non-conductor to separate the liquid metal and selectively interconnect the electrodes;

forming a third substrate for covering the first heater substrate; and surface joining the first, second, third, and first heater substrates.

8. The method of claim 7 wherein:

forming the first and second substrates forms the first and second substrates additionally comprising conductor vias provided in at least one of the substrates;

and further comprising:

filling the conductor vias with the liquid metal at the same time the main channel is filled.

9. The method of claim 7 wherein:

forming the first and second substrates forms the first and second substrates additionally comprising a second heater chamber and a second connecting channel provided in at least one of the substrates, the second connecting channel extending between the second heater chamber and the main channel;

forming the third substrate forms the third substrate comprising first and second clearance chambers provided therein;

and further comprising:

forming a second heater substrate comprising a second suspended heater element; and surface joining the second heater substrate to the second substrate; and surface joining the third substrate to the second substrate locates the first and second heater substrates respectively in the first and second clearance chambers.

10. The method of claim 7 wherein:

forming the first substrate comprises forming the first substrate of ceramic to a first thickness and forming a ground plane on the bottom thereof;

forming the third substrate comprises forming the third substrate of glass; and forming the first heater substrate comprises forming the first heater substrate of silicon and providing a gap around the position of the main channel in the second substrate, the gap having a width about equal to the first thickness.

11. The method of claim 7 wherein:

forming the first heater substrate uses silicon and comprises forming an insulator layer by thermal oxidation before forming the first suspended heater element.

12. The method of claim 7 wherein:

forming the first and second substrates forms the first and second substrates comprising main channels provided in at least one of the substrates, first heater chambers provided in at least one of the substrates, and connecting channels provided in at least one of the substrates, each of the connecting channels extending from a respective one of the heater chambers to a respective one of the main channels, each of the main channels having spaced apart electrodes;

the filling comprises filling each of the main channels at least partially with the liquid metal;

forming the first heater substrate forms the first heater substrate comprising a suspended heater element in fluid communication with a respective one of the connecting channels, each of the suspended heater elements operable to cause a fluid non-conductor to separate the liquid metal in the respective one of the main channels and to selectively interconnect the electrodes in each of the main channels; and and further comprising singulating the first, second, and first heater substrates into individual devices each comprising one of the main channels having liquid metal and spaced apart electrodes, one of the heater chambers, one of the suspended heater elements, and one of the connecting channels.

13. A device, comprising:

a fluid non-conductor;

a first substrate and a second substrate surface joined together;

a main channel defined in at least one of the substrates;

liquid metal in the main channel;

electrodes spaced along the main channel and selectively interconnectable by the liquid metal;

a first connecting channel defined in one of the substrates and containing the fluid non-conductor;

a first heater substrate surface joined to at least one of the substrates and comprising a first suspended heater element in fluid communication with the first connecting channel, the first suspended heater element operable to cause the fluid non-conductor to separate the liquid metal; and a third substrate surface joined to at least one of the second substrate and the first heater substrate.

14. The device of claim 13 wherein:

at least one of the first and second substrates comprises conductor vias provided therein; and at least one of liquid metal, flexible conductive material, anisotropic conductive material, and a combination thereof fills the conductor vias.

15. The device of claim 13 wherein:

at least one of the first and second substrates comprises a second connecting channel provided therein, the second connecting channel in fluid communication with the main channel;

and further comprising:

a second heater substrate surface jointed to the second substrate and comprising a second suspended heater element in fluid communication with the second connecting channel;

and wherein:

the third substrate comprises first and second clearance chambers provided therein, the first and second clearance chambers having the first and second heater substrates therein.

16. The device of claim 13, wherein:

the first substrate comprises a ground plane on the bottom thereof; and the first heater substrate comprises a gap provided therein around the position of the main channel in the second substrate.

17. The device of claim 13, wherein:

the first heater substrate comprises an insulator layer under the first suspended heater element.

18. A device, comprising:

first and second substrates comprising a main channel provided in at least one of the substrates, a first heater chamber provided in at least one of the substrates, and a first connecting channel provided in at least one of the substrates and extending between the first heater chamber and the main channel, the main channel having spaced apart electrodes;

a liquid metal at least partially filling the main channel;

a fluid-nonconductor in at least the second substrate;

a first heater substrate comprising a first suspended heater element, the first suspended heater element operable to cause the fluid non-conductor to separate the liquid metal and selectively interconnect the electrodes; and a third substrate surface joined to at least one of the second substrate and the first heater substrate;

wherein the first, second, and first heater substrates are surface joined.

19. The device of claim 18, wherein:

at least the first and second substrates comprises conductor vias provided therein; and at least one of liquid metal, a flexible conductive material, an anisotropic conductive material, and a combination thereof fills the conductor vias.

20. The device of claim 18, wherein:

at least one of the first and second substrates additionally comprises a second heater chamber and a second connecting channel provided therein, the second connecting channel extending between the second heater chamber and the main channel;

the third substrate comprises first and second clearance chambers provided therein;

and further comprising:

a second heater substrate comprising a second suspended heater element;

and wherein:

the first and second heater substrates are surface joined to the second substrate; and the third substrate is surface joined to the second substrate with the first and second heater substrates in the first and second clearance chambers and in fluid communication with the first and second heater chambers.

21. The device of claim 18, wherein:

the first substrate is of ceramic of a first thickness and comprises a ground plane on the bottom thereof;

the third substrate is of glass; and the first heater substrate is of silicon and comprises a gap provided therein around the position of the main channel in the second substrate, the gap having a width about equal to the first thickness.

22. The device of claim 18, wherein:

the first heater substrate is of silicon and comprises thermal oxide under the first suspended heater element.

* * * * *